US007306231B2

(12) United States Patent
Callahan

(10) Patent No.: US 7,306,231 B2
(45) Date of Patent: Dec. 11, 2007

(54) GAME WITH OBJECT SUSPENDED BY AIR

(75) Inventor: John Callahan, Daytona Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 585 days.

(21) Appl. No.: 10/991,006

(22) Filed: Nov. 16, 2004

(65) Prior Publication Data

US 2006/0105835 A1 May 18, 2006

(51) Int. Cl.
*A63B 67/00* (2006.01)
*A63B 71/00* (2006.01)
*A63F 9/00* (2006.01)

(52) U.S. Cl. ..... 273/447; 463/7; 463/38; 446/3; 446/175; 446/176; 446/179

(58) Field of Classification Search ..... 463/7, 463/16, 20, 38; 446/3, 175–176, 179; 273/121 E, 273/142 R, 447, 448
See application file for complete search history.

(56) References Cited

U.S. PATENT DOCUMENTS 2,155,794 A * 4/1939 Leach ..... 463/66
4,838,550 A * 6/1989 Walker et al. ..... 273/123 A
5,513,772 A * 5/1996 Glaser ..... 221/211
5,573,243 A 11/1996 Bartosik ..... 463/60
5,855,374 A * 1/1999 Shoemaker, Jr. ..... 273/447
5,954,338 A 9/1999 Hampton ..... 273/349
5,967,892 A 10/1999 Shoemaker, Jr. ..... 463/7
6,598,881 B1 * 7/2003 Shoemaker, Jr. ..... 273/447
6,656,043 B2 * 12/2003 Seelig et al. ..... 463/17
6,682,418 B1 1/2004 Mendes et al. ..... 463/6
2005/0261047 A1 * 11/2005 Fiden et al. ..... 463/16

* cited by examiner

*Primary Examiner*—Robert E. Pezzuto
*Assistant Examiner*—Ryan Hsu
(74) *Attorney, Agent, or Firm*—Standley Law Group LLP

(57) ABSTRACT

A pneumatic prize dispensing system for an arcade game. The game includes a pneumatically-controlled method of suspending and controlling the movement encapsulated prizes within a vertically-oriented transparent tube by means of differential air pressure. A player controls the vertical position of the prize by means of a pneumatic control valve. The object of the game is to control the position of the prize capsule to match a target position zone presented to the contestant via a set of visual cues for a predetermined period of time. The game dispenses the encapsulated prize or alternatively, prize tokens, if the game-winning criteria are achieved.

25 Claims, 8 Drawing Sheets

GAME WITH OBJECT SUSPENDED BY AIR

TECHNICAL FIELD OF THE INVENTION

The present invention relates to the general field of arcade games, and more particularly, a pneumatic prize dispensing system for an arcade game.

BACKGROUND AND SUMMARY OF THE INVENTION

The game preferably includes a pneumatically-controlled method of suspending and controlling the movement of encapsulated prizes within a vertically-oriented transparent tube by means of differential air pressure. A player controls the vertical position of the prize by means of a pneumatic control valve. The object of the game is to control the position of the prize capsule to match a target position zone presented to the contestant via a set of visual cues for a predetermined period of time. The game dispenses the encapsulated prize or alternatively, prize tokens, if the game-winning criteria are achieved. Coin, bill, or token-operated versions of this invention may be employed. The game may also be played as a video game version.

The present invention is comprised of a pneumatically-actuated system for an arcade game that is comprised principally of a vertically-oriented transparent "game play" tube, encapsulated prizes, a pneumatic blower system, prize cueing mechanism, player control valve subassembly, visual cueing game displays, sensor arrays, prize capsule diverter subassembly, and coin-operated microprocessor-based control system. Prizes are pre-packaged in capsules that are designed to fit within the game play tube visible to the contestant. Arrays of sensors proximal to the vertical tube are used to provide capsule position and speed feedback information to a microprocessor-controlled control system, which provides additional air-flow control to compensate for weight differences between prizes. This automatic weight compensatory feature eliminates control sensitivity problems that would otherwise arise with the use of prize capsules of different density and allows a wider range of prizes to be offered to the contestant.

When the contestant starts the game by insertion of coins, tokens, or other media, a prize is inserted into the vertical transparent tube via a prize cueing turntable mechanism and a pneumatic blower and control system is enabled. The capsule is lifted vertically to an equilibrium position determined by balancing the capsule weight against the differential air pressure generated across a prize-carrying capsule by the blower. The contestants control the vertical position of the prize capsule by means of a pneumatic control valve that meters the blower-generated air-flow rate within the vertical tube. The contestant is challenged to maintain the position of the prize capsule within a visually presented target zone indicated by a set of lights or light-emitting diodes (LEDs). The target zone may be stationary or moving and also may change in size and speed to increase the challenge to the contestant. The target zone may optionally be bracketed by "warning" zones to let the contestant know that he/she is in danger of losing the game. A visual clock that may be stationary or integrated within the target zone display, may be used to inform the contestant of the remaining game time available. Additionally, audible cues, music, sounds and haptic information may be presented to the contestant for additional effect. The prize is delivered to the winning contestant via a delivery tube to an exit port located on the exterior frame of the game. An incandescent or other "win" light or visual cue may be proximal to the exit port to assist the winner in locating his/her prize. A unique concept embodied within this invention is that it actually uses the prize you might win as the actual "playing piece" for the game. This implies that a different playing piece could be used for each game played. Additionally, a ticket dispensing version of this game may be embodied for redemption centers that may not want a machine that dispenses prizes directly. In this case, the prize capsules are replaced by a single capsule that remains in the vertical tube and is used over and over making the dispensing mechanisms unnecessary. A ticket dispenser is instead added and tickets are dispensed to a winner. An additional provision to dispense consolation tickets may be embodied within the game to accommodate requirements (e.g. Canada) to issue such tickets in the event a prize is not won.

The present invention also includes versions of the game that may be played as a video game. Such versions of the present invention may include a video game machine comprised of a video monitor, a processor, and at least one player interface. This example of the present invention would use the monitor for displaying virtual vertical tube, target and warning zone images, and at least one player controllable capsule image. A processor would be utilized to generate the images on the monitor and also for managing game play. The player interface is intended to be any of the typical variations of equipment used by a player for the input of player control into the game. The interface may be comprised of a button, a joystick, a ball, finger-on-glass touch sensitive interface.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
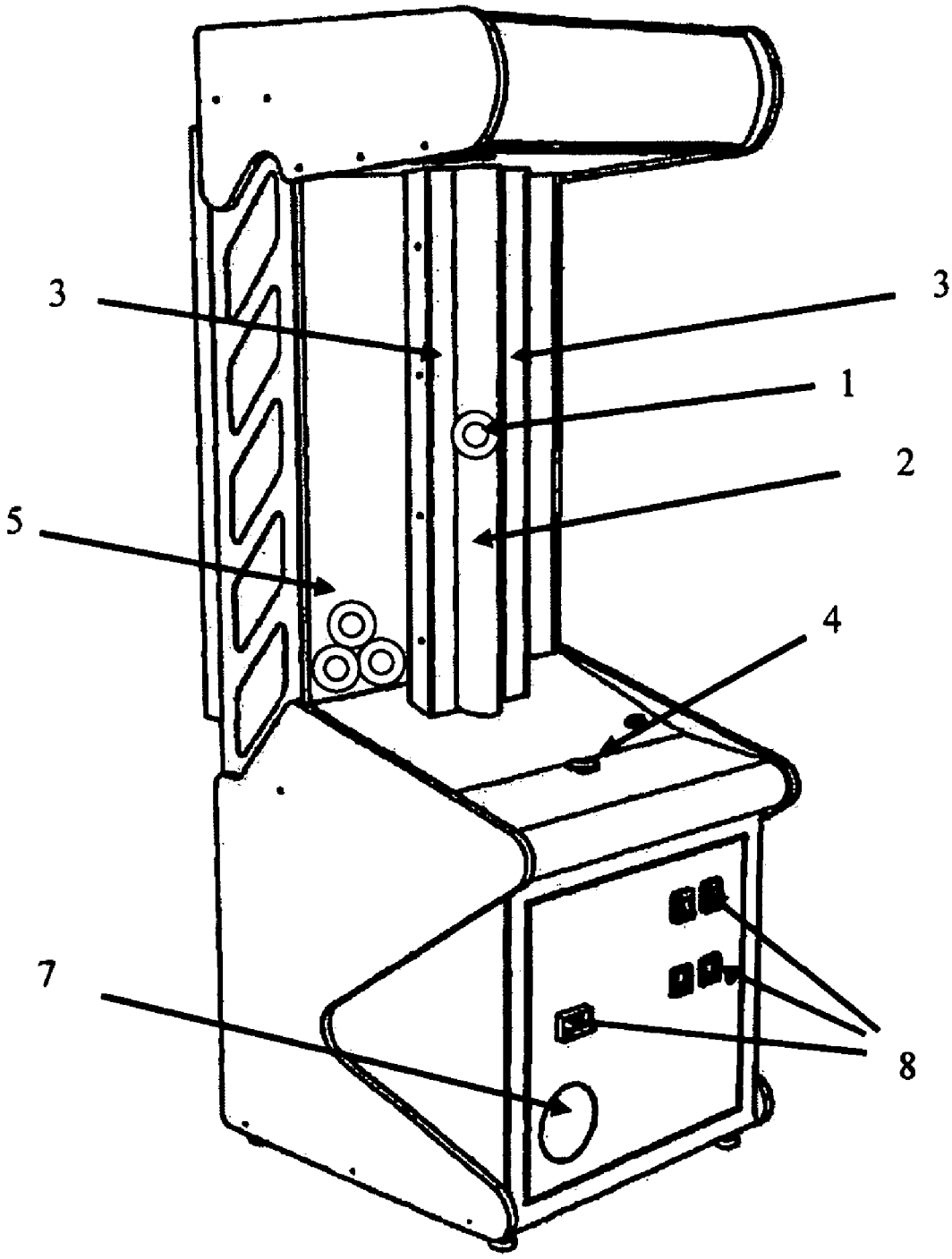
FIG. 1 is a pictorial view of an example embodiment of a game of the present invention.
Figure 2:
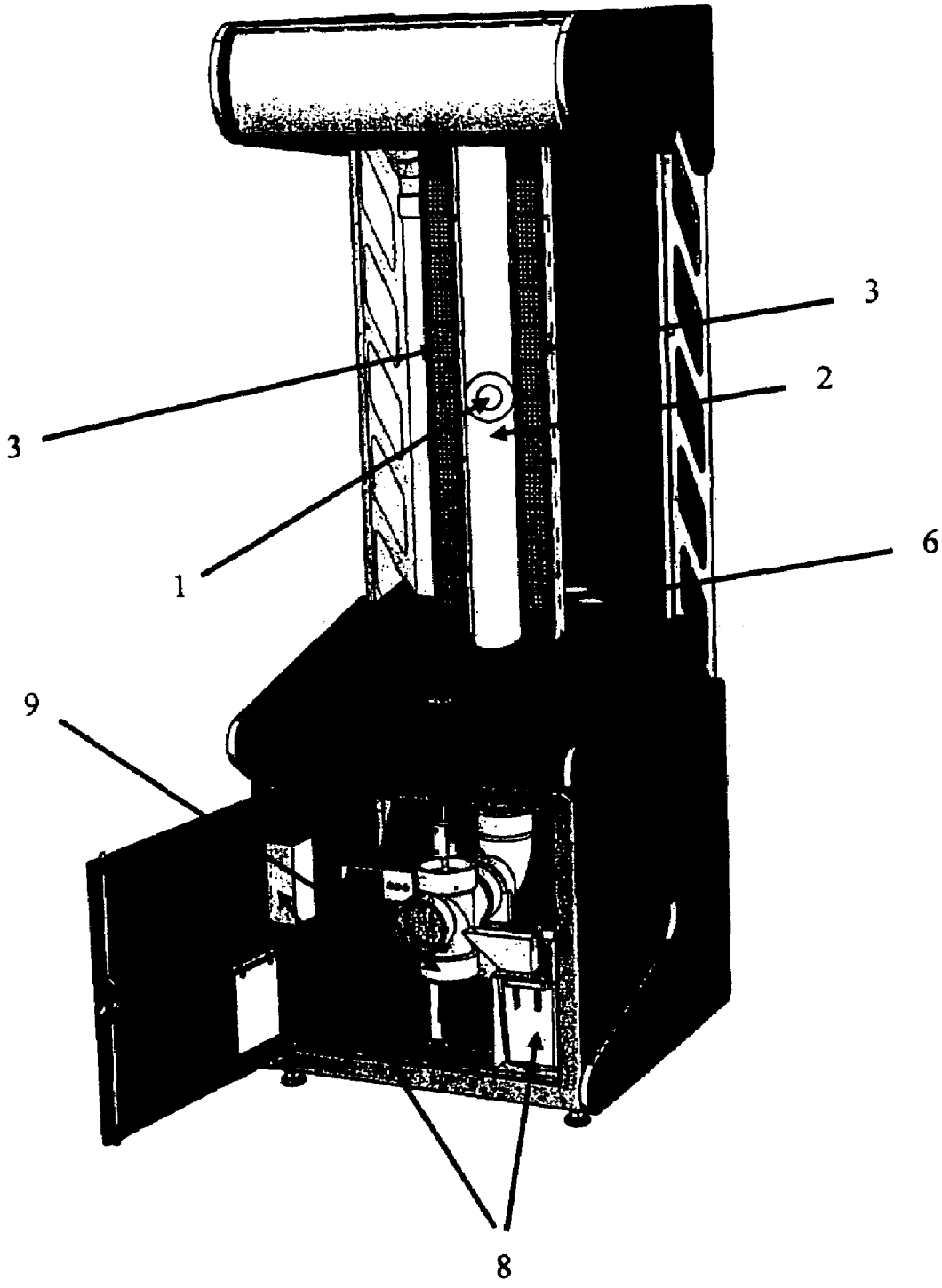
FIG. 2 is a pictorial view of an example embodiment of a game of the present invention with exposed blower and control subassemblies.

FIGS. 1 and 2 show one embodiment of the game of the present invention. One embodiment of the present invention is a game comprised of a prize capsule 1, a vertically oriented transparent game play tube 2, target and warning zone visual displays and capsule position sensors arrays 3, player control knob 4, prize capsule reservoir 5, prize dispensing turntable 6, prize dispensing port 7, coin/bill/token acceptor ports and subassembly 8, and blower and push rod control subassembly 9. The target and warning zone visual displays and capsule position arrays are used to provide visual cues to the contestant and to provide prize capsule positional information to a microprocessor-based control system respectively. A player control knob 4 is used by the contestant to control the air-flow rate through the game play tube 2 provided by an air blower unit 9 allowing vertical positional control over the prize capsule. Prize capsules 1 are introduced into the game play tube 2 via a prize dispensing turntable 6 which is located beneath the prize capsule reservoir 5. Although it is to be appreciated that other dimensions and geometry configurations can be employed that fall within the spirit of this invention, in one embodiment the prize capsule is comprised of a transparent sphere that contains a prize with the size of the prize capsule defined such that it provides a proper fit with the game play tube requisite for proper air-flow and capsule transport. If the contestant achieves the game winning criteria and wins a prize, the prize is presented to the winner via the prize dispensing port 7. Alternatively, a ticket dispensing version of this game may be embodied for redemption centers that may not want a machine that dispenses prizes directly. In this case, the prize capsules are replaced by a single capsule that remains in the vertical tube and is used over and over making the dispensing mechanisms unnecessary. A ticket dispenser is instead added and tickets are dispensed to a winner. An additional provision to dispense consolation tickets may be embodied within the game to accommodate requirements (e.g. Canada) to issue such tickets in the event a prize is not won. Coin, bill, and token ports 8 are provided to accept currency to initiate the game.

Figure 3:
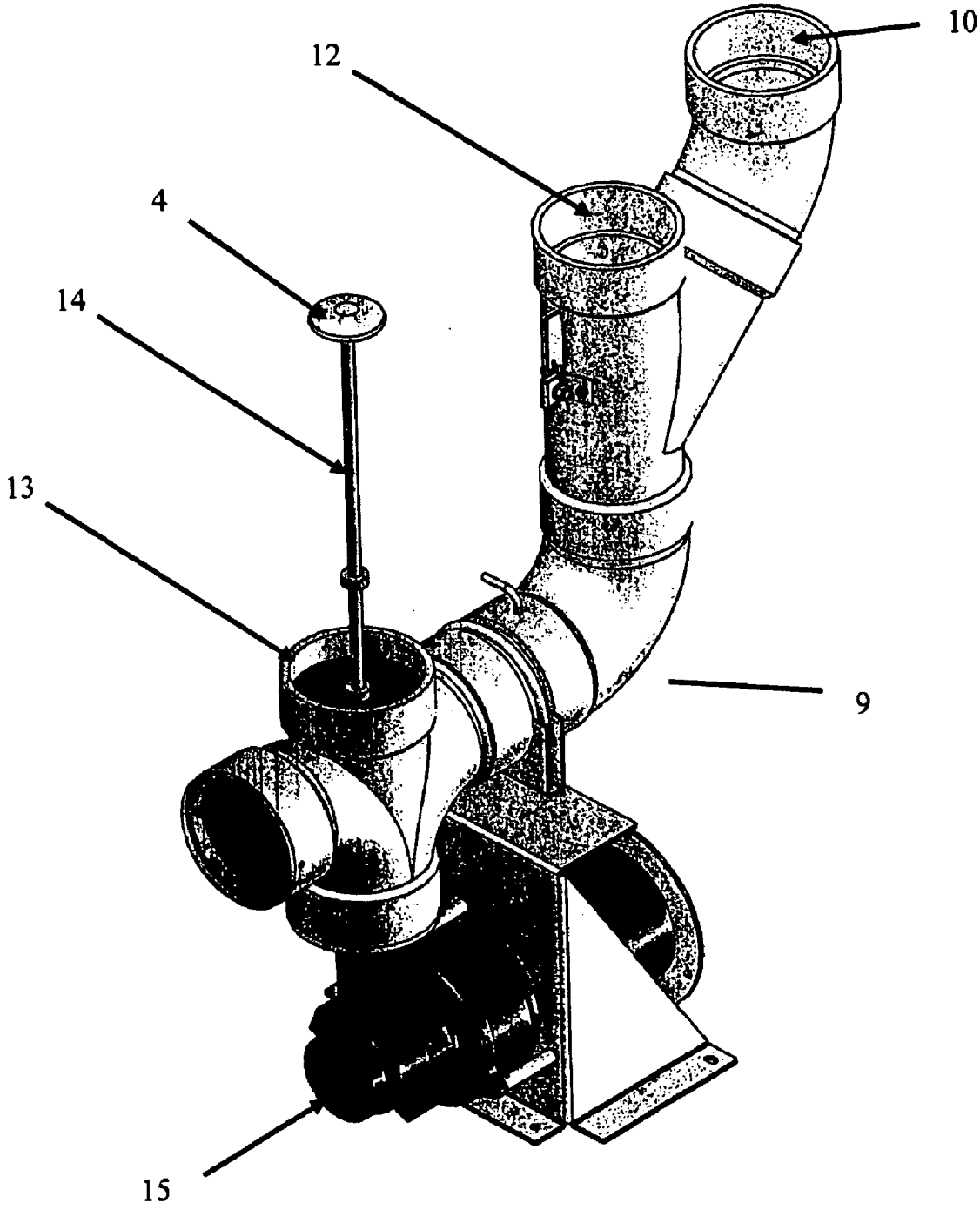
FIG. 3 is a pictorial view of an example embodiment of blower and push rod control assembly.

FIG. 3 illustrates one example of the preferred embodiment of the blower and push rod control assembly. A player control knob 4 communicates mechanically with an air control valve 13 via push rod 14. An air blower 15 supplies compressed air into an air plenum 12 which is attached to the lower end of the game play tube 2. A prize acceptor chute 10 permits transport of prize capsules from the prize reservoir 5 into the game play tube 2. In another embodiment, a lower speed of a two-speed blower provides sufficient air-flow through the game play tube 2 such that the prize capsule 1 is suspended within the vertical playing zone visible to the contestant, while the higher speed provides for sufficient air-flow to load and discharge prize capsules at the beginning and end of the game. A variable speed control option is preferred to allow the game operator or game servicing technician the ability to balance the air-flow via a speed control switch to optimize the movement of the prize capsule 1 within the game play tube 2 as necessary, for a variety of different weights of prize capsules. The air valve 13 is actuated by the contestant via the control knob 4 and a simple mechanical push rod 14. The air valve 13 is configured to be blown in the open position by air pressure differences induced by the blower which in turn permits a high air flow-rate setting on the blower to initially blow a prize capsule into the game play tube. Pushing down on the control knob closes the air valve and cuts off the air-flow to the game play tube proportional to the distance the knob is pressed. This action consequently allows the prize capsule to proportionally fall within the game tube. Alternatively releasing the control knob allows the blower to open the valve more fully which introduces a greater amount of air-flow to the game play tube lifting the prize capsule to a higher position. In this manner, the contestant is able to control the vertical position of the prize capsule within the game play tube to play the game. These simple operations, knob-up/capsule-up and knob-down/capsule-down, provide a superior and naturally intuitive feedback to the contestant. An additional embodiment includes the use of a linear electric motor (not shown) to assure that the air valve 13 is forced open at the conclusion of the game and the blower speed level set to the high level so that the prize can be either delivered to the winning contestant or returned to the prize capsule reservoir. This is necessary since a player could hold the air valve shut and the game would never end. Additional features would allow a provision for the linear motor to retract in a safe manner so as not to cause injury to the contestant by pinching from control knob movement.

Figure 4:
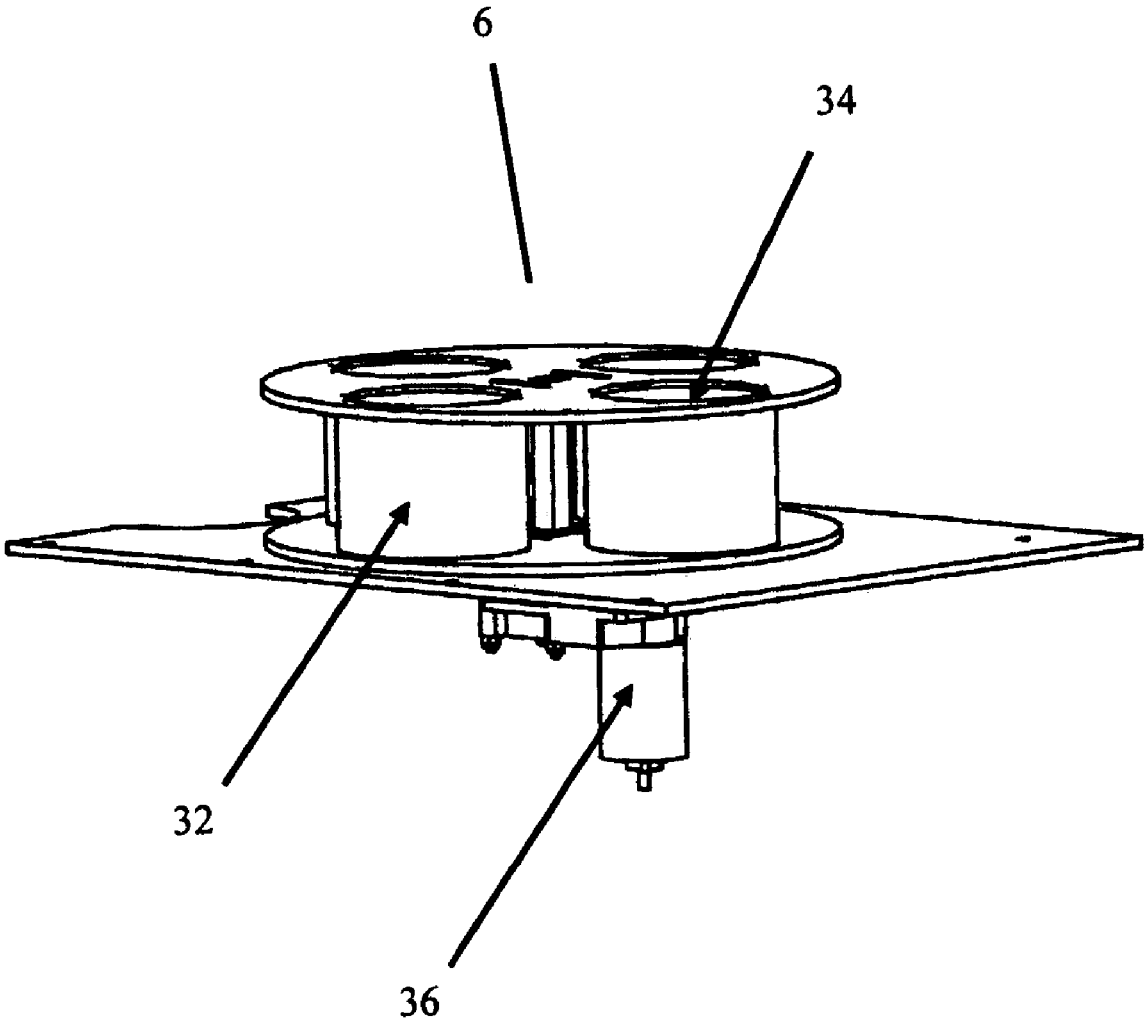
FIG. 4 is a pictorial view of an example embodiment of a dispensing turntable subassembly.

FIG. 4 illustrates an embodiment of the prize dispensing turntable 6 which is positioned between the prize reservoir 5 and the prize acceptor chute 10. The turntable is preferably comprised of a plurality of cylindrical prize capture cells 32 mounted within a motorized rotary support frame 34. The support frame is rotationally driven via an electric motor 36. The turntable works in a fashion similar to gumball dispensers known to those skilled in the art. An optical sensor located directly below the turntable is used to detect when the passage of a prize capsule into the prize acceptor chute has occurred. This sensor allows the turntable to be stopped immediately once a prize capsule has been introduced preventing insertion of more than one prize capsule into the game. If a capsule is not sensed within a predetermined time period, the turntable is shut down and a trouble indicator is presented to the operator.

When the game begins, the turntable turns until a sensor detects a prize has been collected from the prize capsule reservoir and drops it into the prize acceptor chute. In one embodiment, electric motor 36 embodies a high torque feature to drive the turntable against frictional air-seals needed to mitigate excessive air pressure loss within the whole assembly, as well as against the combined weight of prize capsules within the prize capsule reservoir. An electric current control feature is embodied to limit motor torque to avoid motor and capsule damage in the event of a prize capsule jam a well as an automatic method of self-clearing such jams. In one embodiment, the automatic jam clearing feature consists of reversing the turntable rotary motion direction for approximately 1-second when an overcurrent condition is detected followed by a subsequent reversal in the opposite direction in an attempt to clear the problem. This cyclic reversal process would continue for predetermined number of cycles. If after the requisite number of cycles is completed and the problem is not corrected, the motor is shut down and a trouble indicator would be presented to the operator.

Figure 5:
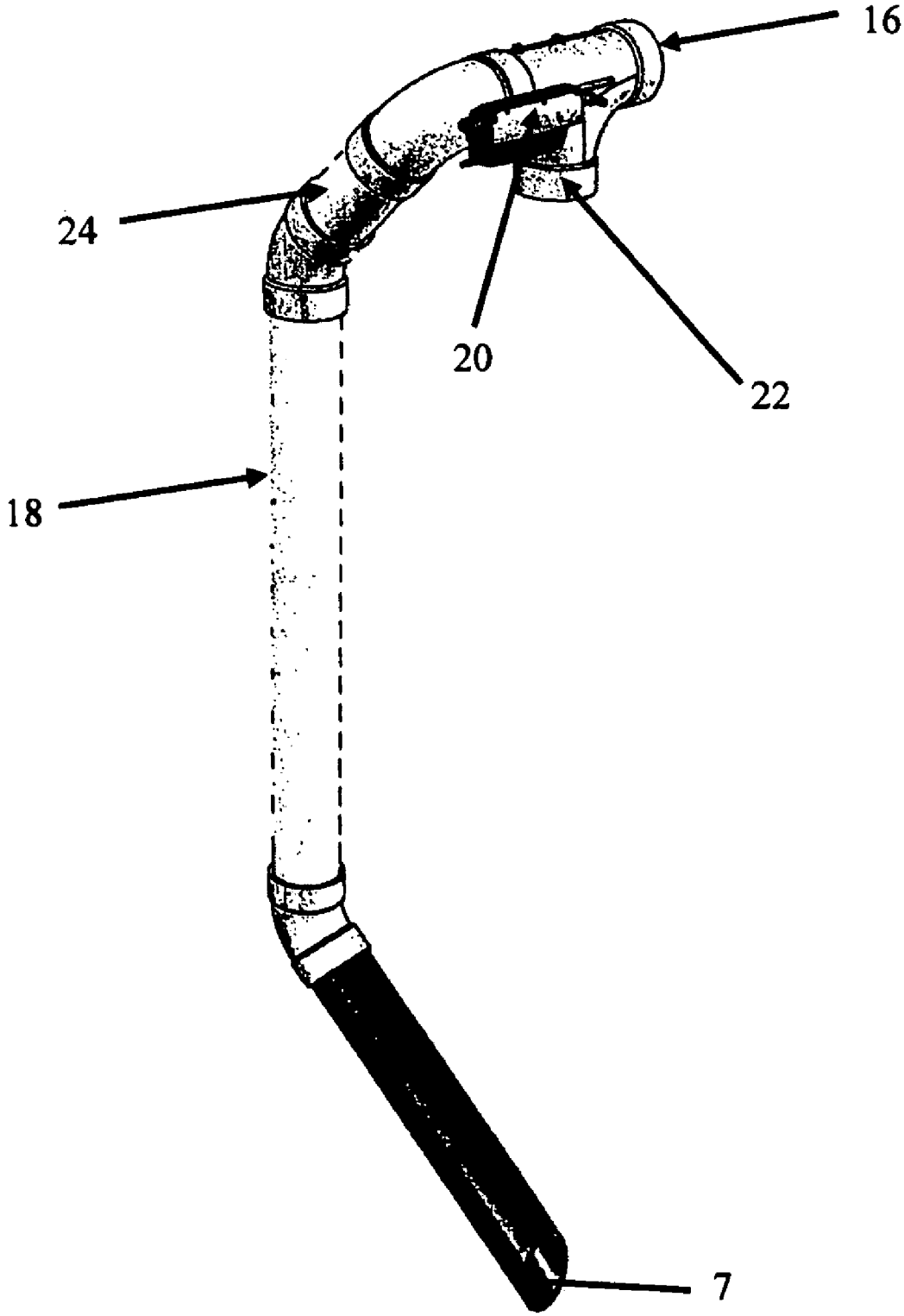
FIG. 5 is a pictorial view of an example embodiment of a prize dispensing chute subassembly.

FIG. 5 illustrates one embodiment of the prize dispensing chute subassembly, which is comprised of a prize dispensing chute diverter mechanism 16, 20, 22, and 24 and dispensing chute 18 which terminates with the prize dispensing port 7. The prize dispensing chute diverter mechanism directs the transport of prize capsules either to a winning contestant or back to the prize capsule reservoir in event the game is lost.

Figure 6:
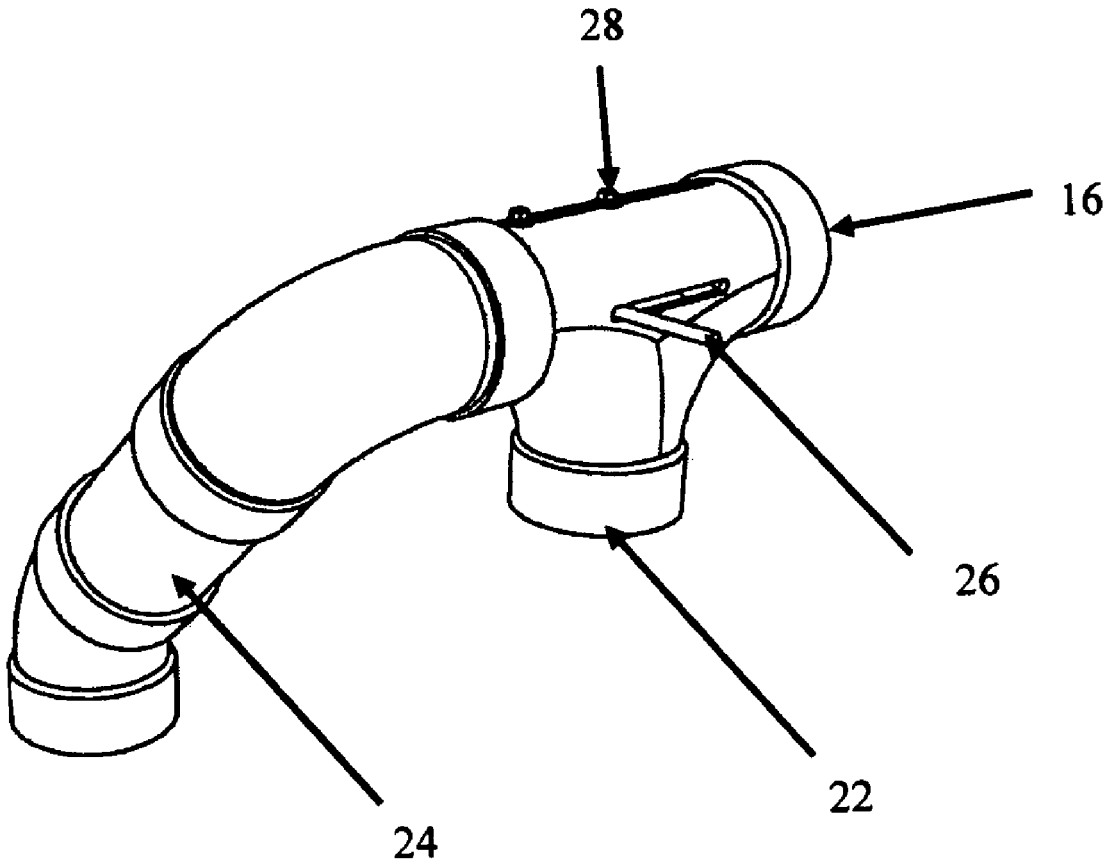
FIG. 6 is a detailed pictorial view of an example embodiment of a prize dispensing chute subassembly.
Figure 7:
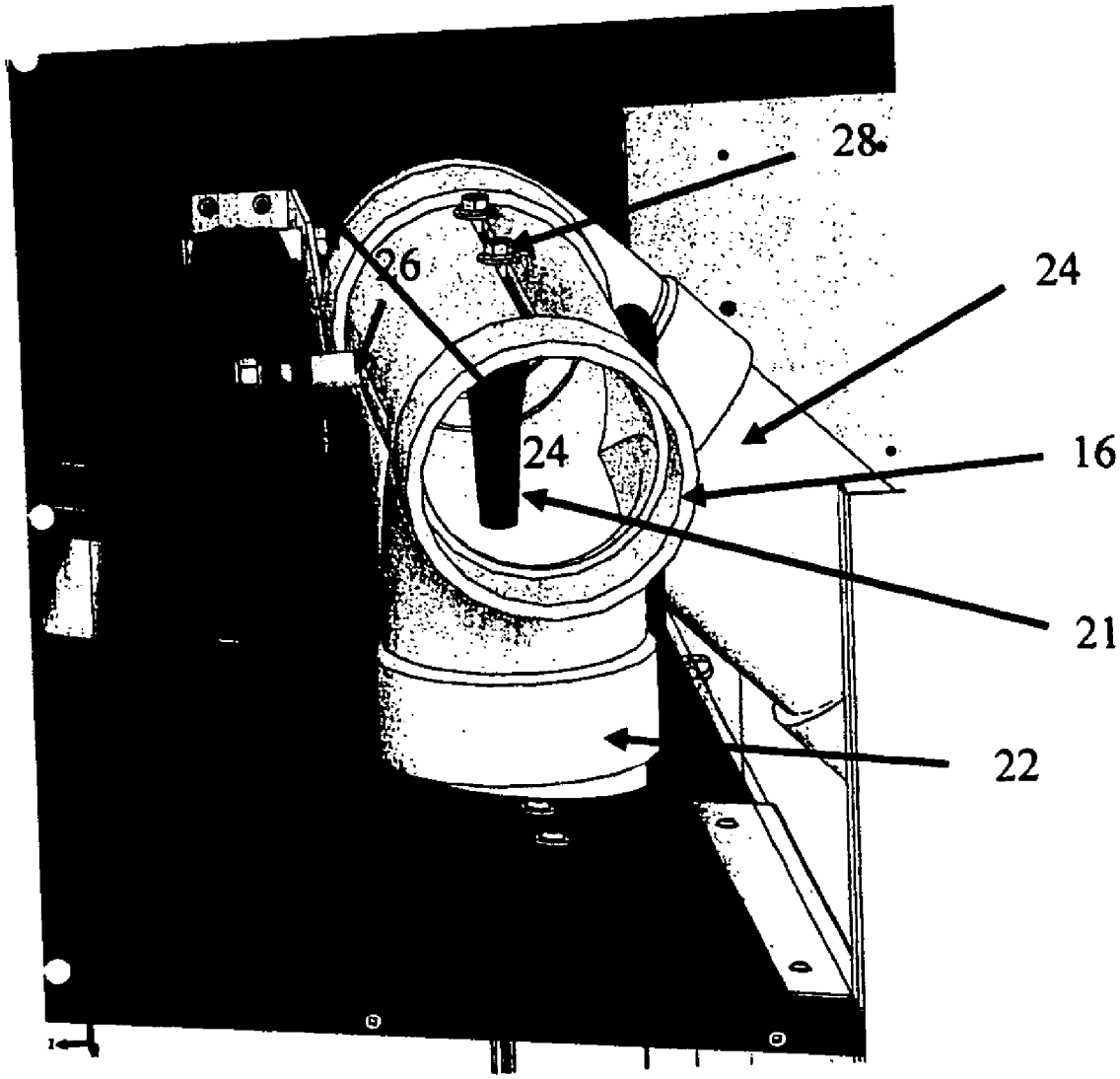
FIG. 7 is a pictorial view of an example embodiment of a prize dispensing chute diverter mechanism.

FIGS. 6 and 7 illustrate a detail of an embodiment of a prize dispensing chute subassembly and diverter mechanism. Port 22 communicates with the top end of the vertical game play tube 2. Chute 24 provides a path to dispense prizes to winning contestants. Port 16 communicates with the prize reservoir 5 which provides a path to return prizes to the game not won by the contestant. A linear electric actuator 20 is used to drive a slideable prize diverter barrier 21 supported by fasteners 28 via mechanical control rod 26. The linear electric actuator 20 has three positions: CLOSED, DISPENSE, and RETURN. The CLOSED position of the diverter is the default normal position which is positions the diverter barrier 21 midway between the DISPENSE and RETURN extreme stroke positions. This blocks prize capsules from escaping the game play tube until the game is over or in the event excessive air pressure is inadvertently applied. In the DISPENSE position, the linear actuator is fully extended positioning the diverter barrier 21 in a manner allowing the prize capsule to be dispensed to the winning contestant via the prize dispensing chute 7, 18, and 24. In the RETURN position, the linear actuator is fully retracted positioning the diverter barrier 21 in a manner allowing the prize capsule to be returned to the prize capsule reservoir via port 16 for reuse. It is to be appreciated that other methods of diverter barrier actuation are feasible to one skilled in the art. An additional feature includes the use of optical sensors to sense whether a prize has been dispensed to the contestant or returned to the game. In one embodiment, the structures of the acceptor chute 10, air plenum 12, prize air control valve 13, and prize dispensing chute subassembly components 7, 16, 18, 22, 24 are comprised of commercially available 4-½-inch outside diameter, 4-inch inside diameter, schedule 40 PVC sanitary pipe and fittings that are connected in a manner which promotes an air-tight seal throughout. Similarly, in one embodiment the dimensions of the transparent game play tube 2 are those compatible with the schedule 40 PVC sanitary pipe and fittings described above.

Figure 8:
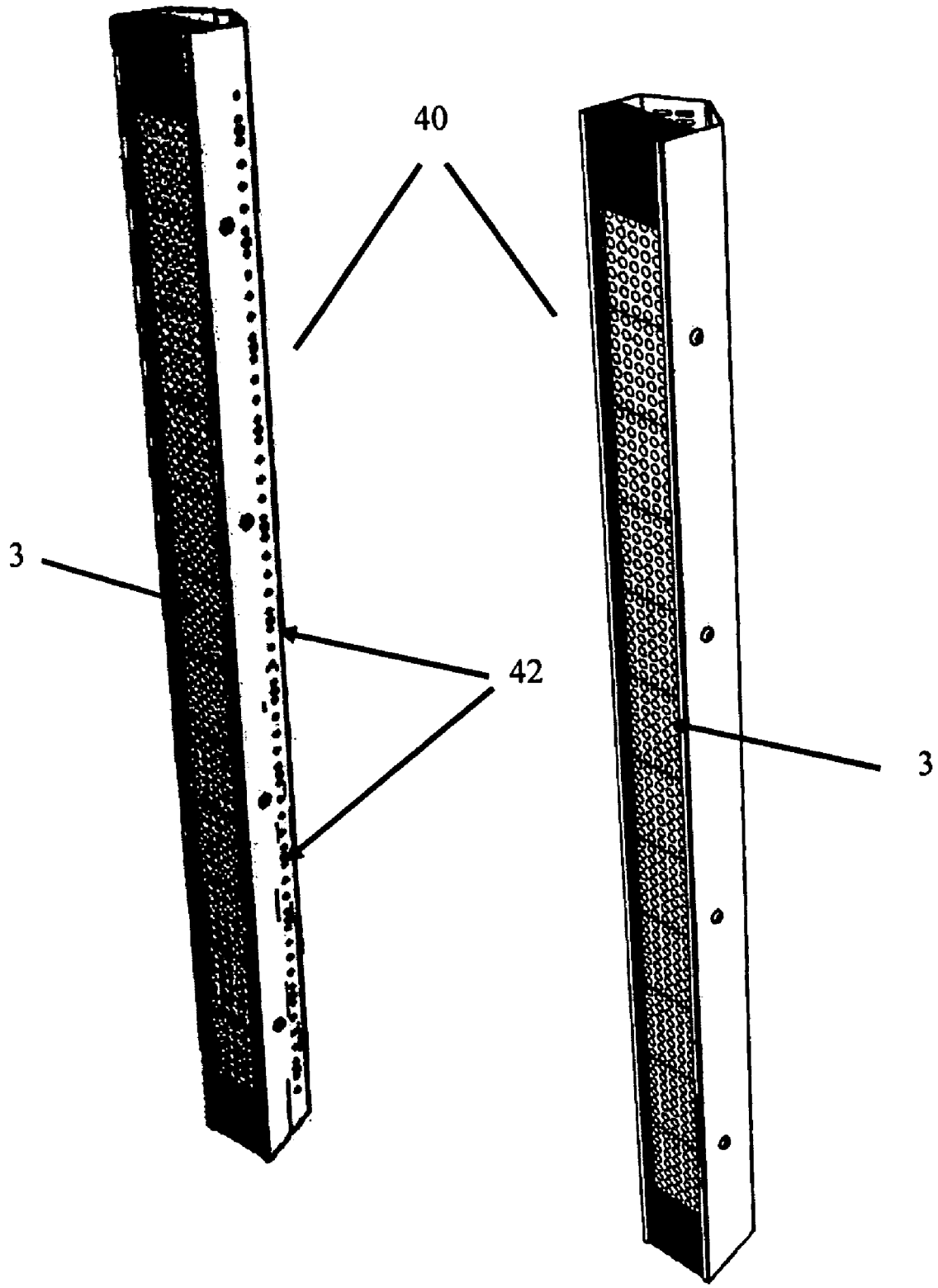
FIG. 8 is a pictorial view of an example embodiment of a target display and prize detection sensor subassembly.

FIG. 8 illustrates an embodiment of the target and warning zone visual displays 3 and prize location sensor arrays 42. The visual displays 3 may be comprised of lights, such as light emitting diode (LED) arrays which are controlled by a microprocessor-based control system commonly known to those skilled in the art. The visual display presents to the contestant a "target" area which can vary in size, position, movement, and speed. Since the object of the game is to have the contestant keep the prize capsule within the target zone, the target zone may initially be large and stationary to provide the contestant a game familiarization period. As the game progresses, the target area begins to move with changes in speed and size in a manner to challenge the contestant. The target zone may optionally be bracketed by "warning" zones to let the contestant know that he/she is in danger of losing the game. A visual clock that may be stationary or integrated within the target zone display may be used to inform the contestant of the remaining game time available. Additionally, audible cues, music, sounds and haptic information may be presented to the contestant for additional effect. The arrays 42 are preferably comprised of transmitting and receiving optical sensors capable of sensing the position of the prize capsule through the transparent walls of the game play tube and are accordingly positioned on each side and adjacent to the game play tube. These sensors are used to determine if the prize capsule is in the target or danger area. Additionally, these sensors are used to provide capsule position feedback information to a microprocessor-controlled control system, which provides additional air-flow control to compensate for weight differences between prizes. This is achieved by initially calibrating the machine to prize capsules of various weights whereby the initial insertion speed of a prize capsule within the game play tube is measured by the sensors. Typically, the heavier the prize capsule, the slower the insertion speed. The speed of the blower 15 is adjusted to provide optimum movement of the particular prize capsule within the game tube and the blower speed setting is programmed into the microprocessor controller in the form of a "look-up" table. The look-up table is filled by similarly calibrating the system using a spectrum of prize capsules having weights that fall within the expected range of prizes. Once the game is calibrated, the microprocessor automatically adjusts the blower to the optimum air-flow for any prize capsule it encounters. This automatic weight compensatory feature eliminates control sensitivity problems that would otherwise arise with the use of prize capsules of different density and allows a wider range of prizes to be offered to the contestant. It will be appreciated that it is not necessary to scan the sensors outside of the target or warning areas, since if the capsule is not seen in those zones, it can be assumed that the capsule is not there and the contestant has lost the game. In one embodiment, the transmission and receiving sensor pairs are relatively positioned in a manner that will mitigate the potential for optical cross-talk (light leakage) from proximate sensors. The use of light tunnels and other optical isolation methods known in the art may also be embodied to mitigate optical cross-talk. Although it is appreciated that any sensor pair spacing which allows proper sensing may be acceptable, spacing between optical sensor pairs in this embodiment is 0.7-inches. The sensors may be mounted on P.C. boards of the appropriate dimensions to facilitate installation and servicing. In this embodiment, it is preferred that all the sensors be constantly monitored during the game to avoid cheating by the contestant, whereby it would be possible to deceive the sensors by blocking the optical path between sensors using an object similarly sized to that of the prize. Sensor logic built into the control circuitry would sense activation of more than the minimum requisite number to sense a legitimate prize capsule confirming game deception and subsequently shut down the game or indicate that cheating has occurred.

The embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A game contained in a console for at least one game player comprising:

at least one encapsulated prize;

a transparent game tube used for containment of the said encapsulated prize;

an encapsulated prize reservoir for containing said encapsulated prize;

a collection mechanism to collect, transport, and insert a said encapsulated prize from said prize reservoir into said transparent game tube;

a source of compressed air used for transport of said encapsulated prize;

an air-flow control valve subassembly used to meter said compressed air;

a player control knob used to control the said air-flow control valve;

a game/contestant communications interface;

sensor arrays used to sense the position and speed of said encapsulated prize;

prize detection sensors;

prize diverter mechanism;

a currency acceptor mechanism;

a prize dispensing mechanism; and a micro-processor control system and computer software used to control the said game.

2. The game of claim 1 wherein said encapsulated prize is a transparent hollow sphere used to contain a prize.

3. The game of claim 1 wherein components comprising said collection mechanism, game tube, and prize dispensing mechanism are constructed from commercially available schedule 40 PVC sanitary pipe and fittings.

4. The game of claim 1 wherein said air-flow control valve subassembly is operated by a contestant control knob.

5. The game of claim 1 wherein said transparent game tube is vertically oriented.

6. The game of claim 1 wherein said prize collection mechanism is a motorized turntable having at least one cylindrical prize capture cell mounted within a motorized rotary support frame.

7. The game of claim 1 wherein a dispensing system issues tokens or tickets vice a said encapsulated prize.

8. The game of claim 1 wherein the said game dispenses consolation tokens or tickets in the event a prize is not won.

9. The game of claim 1 wherein the said source of compressed air embodies a speed control option to regulate air-flow.

10. The game of claims 1 and 4 and wherein the said air-flow control valve subassembly is proportionally-metered to the position of the said contestant control knob.

11. The game of claim 1 wherein the flow-rate said source of compressed air is controlled by a microprocessor.

12. The game of claims 1 and 11 wherein a prize capsule velocity determination scheme using the said sensor array and said microprocessor are used to optimize and control air-flow rates produced by said compressed air source to accommodate prizes of different densities.

13. The game of claim 1 wherein said sensor array is optical.

14. The game of claim 1 wherein said game/contestant communications interface is a microprocessor-controlled light-emitting diode (LED) array.

15. The display of claim 14 wherein said LED array is multicolored.

16. The display of claim 14 wherein said display consists of illuminated target and warning zones that are appear to be stationary or move.

17. The display of claim 14 wherein said display consists of illuminated target and warning zones that appear to change shape or speed.

18. The game of claim 1 wherein said prize diverter mechanism is actuated by a linear actuator.

19. The linear actuator of claim 18 is controlled by said microprocessor.

20. The linear actuator of claim 18 may be discretely positioned to direct the flow-path of said encapsulated prize.

21. A video game machine for playing a game as described in claim 1, comprising:

a monitor for displaying a playing virtual images and at least one player controllable image;

a processor in communication with said monitor for generating said images and managing game play; and at least one player interface.

22. The video game machine of claim 21 wherein said at least one player interface is comprised of a button.

23. The video game machine of claim 21 wherein said at least one player interface is comprised of a joystick.

24. The video game machine of claim 21 wherein said at least one player interface is comprised of a ball.

25. The video game machine of claim 21 wherein said at least one player interface is comprised of a finger-on-glass touch sensitive panel.

* * * * *